US006708904B2

(12) United States Patent
Itatsu

(10) Patent No.: US 6,708,904 B2
(45) Date of Patent: Mar. 23, 2004

(54) NOZZLES SUITABLE FOR USE WITH FLUID INJECTORS

(75) Inventor: Ryuji Itatsu, Obu (JP)

(73) Assignee: Aisan Kogyo Kabushiki Kaisha, Aichi-ken (JP)

( * ) Notice: Subject to any disclaimer, the term of this patent is extended or adjusted under 35 U.S.C. 154(b) by 30 days.

(21) Appl. No.: 10/046,549

(22) Filed: Jan. 16, 2002

(65) Prior Publication Data

US 2002/0092930 A1 Jul. 18, 2002

(30) Foreign Application Priority Data

Jan. 17, 2001 (JP) ..... 2001-009448

(51) Int. Cl.[7] ..... F02M 61/00

(52) U.S. Cl. ..... 239/533.12; 239/533.3; 239/533.14; 239/596

(58) Field of Search ..... 239/533.3, 533.12, 239/533.14, 596

(56) References Cited

U.S. PATENT DOCUMENTS 5,685,491 A * 11/1997 Marks et al. ..... 239/533.12
5,924,634 A * 7/1999 Arndt et al. ..... 239/533.12
6,357,677 B1 * 3/2002 Ren et al. ..... 239/596

FOREIGN PATENT DOCUMENTS

JP 11 200998 7/1999

* cited by examiner

*Primary Examiner*—Robin O. Evans
(74) *Attorney, Agent, or Firm*—Dennison, Schultz, Dougherty & MacDonald

(57) ABSTRACT

A fluid injection nozzle (5) is mounted on a fluid injector valve (1) in order to control the flow of (and atomize) fluid passing through an injection hole (3*b*) of the fluid injector (1). The fluid injection nozzle (5) may include at least one nozzle hole (5*a*) that comprises an inlet hole (51*a*), an intermediate hole (52*a*) and an outlet hole (53*a*). These holes preferably serve to impart a step-wise control of the fluid flow exhausted from the injection hole (3*b*). The intermediate hole (52*a*) may have a longitudinal axis (L2) that extends substantially perpendicular toward a nozzle axis (L1). The intermediate hole (52*a*) may include a first terminal end that communicates with the inlet hole (51*a*) and a second terminal end that communicates with the outlet hole (53*a*). The intermediate hole (52*a*) preferably has a substantially uniform width (W) along substantially the entire length in the longitudinal axis (L2). The outlet hole (53*a*) may have the central axis (L3) that is displaced from the longitudinal axis (L2) of the intermediate hole (52*a*) by a distance (Y).

25 Claims, 5 Drawing Sheets

NOZZLES SUITABLE FOR USE WITH FLUID INJECTORS

This application claims priority to Japanese application serial number 2001-009448, which application is hereby incorporated by reference herein in its entirely.

BACKGROUND OF THE INVENTION

1. Field of the Invention

The present invention relates to fluid injection nozzles that serve to control the flow of a fluid, and in particular to fluid injection nozzles that are adapted to atomize a liquid supplied from a fluid injection valve. The present invention also relates to fluid injectors having such fluid injection nozzles. Such fluid injection nozzles and fluid injectors may be, e.g., utilized within internal combustion engines for vehicles.

2. Description of the Related Art

Japanese Laid-Open Patent Publication No. 11-200998 teaches a fuel injection nozzle as shown in FIG. 7, which shows a cross-sectional view of a part of the fuel injection nozzle, and FIG. 8, which shows a broken-away plan view of the known fuel injection nozzle.

As shown in FIG. 7, a fuel injection valve 101 includes a valve seat 103 and a movable valve 104. The valve seat 103 includes a valve seat surface 103*a* and an injection hole (port) 103*b*. The valve seat surface 103*a* is formed on an inner wall or surface of a fuel flow channel. The injection hole 103*b* is disposed on the downstream side of the valve seat surface 103*a*. The valve 104 includes a contact surface 104*a* that is designed to contact the valve seat surface 103*a*.

The fuel injection valve 101 is operable to selectively exhaust fuel via the injection hole 103*b* when the contact surface 104*a* of the valve 104 moves away from the valve seat surface 103*a* of the valve seat 103 (valve opening operation). On the other hand, fuel injection stops when the contact surface 104*a* of the valve 104 contacts and seals the valve seat surface 103*a* of the valve seat 103 (valve closing operation).

A fuel injection nozzle 105 is disposed on the bottom or downstream surface of the valve seat 103 and includes upper and lower plate members 151, 153. The upper plate member 151 is disposed so as to contact the bottom surface of the valve seat 103 and includes eight inlet holes 151*a* (see FIG. 8) that extend through the upper plate member 151.

As shown in FIG. 7, the lower plate member 153 is mounted on the valve seat 103, such that it is disposed on the downstream side (lower side as viewed in FIG. 7) of the upper plate 151. A recess 153*b* is formed on the upstream side of the lower plate member 153. The recess 153*b* cooperates with a downstream side surface of the upper plate member 151 and defines a substantially circular fuel chamber 155 between the upper and lower plate members 151, 153. As shown in FIG. 8, the lower plate member 153 includes four outlet holes 153*a* (see FIG. 8) that extend through the lower plate member 153.

According to the known fuel injection nozzle 105 described above, when the fuel injection valve 101 opens, pressurized fuel is forced through the injection hole 103*a* of the valve seat 103. The fuel then flows through the inlet holes 151*a* of the upper plate member 151, through the fuel chamber 155 and then is exhausted through the outlet holes 153*a*.

Therefore, according to the known fuel injection nozzle 105, the fuel flows into the fuel chamber 155 from the inlet holes 151*a* of the upper plate member 151 and then flows horizontally within the fuel chamber 155 along the recess 153*b*. However, because the inlet holes 151*a* and the outlet holes 153*a* are not aligned with each other, the fuel flows into each outlet hole 153*a* from all directions. Because the outlet holes 153*a* are inclined relative to the bottom of the recess 153*b*, the angle of the fuel flow that enters the respective outlet holes 153*a* varies in response to the direction of the fuel flow within the recess 153*b*. If an increased amount of fuel flows at an obtuse angle relative to the outlet holes 153, the fuel flow will stabilize, thereby generating atomized fuel particles having relatively large diameters. Because small diameter fuel particles are desired, this known design is disadvantageous.

SUMMARY OF THE INVENTION

It is, accordingly, one object of the present invention to teach improved fluid injection nozzles and fluid injection valves that can reliably generate relatively small diameter fuel particles.

According to one aspect of the present teachings, fluid injection nozzles are taught that are arranged and constructed to be mounted on a fluid injector in order to control the flow of a fluid exhausted through an injection hole of the fluid injector. The fluid injection nozzle may include at least one nozzle hole that has an inlet hole, an intermediate hole and an outlet hole. The combination of the inlet hole, the intermediate hole and the outlet hole serves to provide a step-wise control of the flow of the fluid ejected from the injection hole, which preferably serves to atomize the fluid passing through the nozzle hole. The intermediate hole may have a longitudinal axis that extends substantially perpendicularly with respect to a nozzle axis. Further, the intermediate hole may include a first terminal end that communicates with the inlet hole and a second terminal end that communicates the outlet hole. In addition, the intermediate hole may preferably have a substantially uniform width along substantially the entire length of the longitudinal axis. The outlet hole may have a central axis that is displaced from the longitudinal axis of the intermediate hole, such that the central axis and the longitudinal axis do not intersect.

If the fluid flows through the intermediate hole, which intermediate hole has a longitudinal axis that extends substantially perpendicularly with the nozzle axis and has a substantially uniform width along substantially the entire length in the longitudinal axis, direction may be imparted to the fluid flow along the longitudinal direction of the intermediate hole. In other words, the direction of the fluid flow within the intermediate hole may preferably substantially align with the longitudinal axis of the intermediate hole. In addition, if the outlet hole has a central axis that is displaced from the longitudinal axis of the intermediate hole, the center of the fluid flow stream preferably does not turn in the exact opposite direction at the second terminal end of the intermediate hole. As a result backward flow within the intermediate hole can be prevented.

Due to a multiplied or amplified atomization effect imparted to the fluid by causing the fluid to flow along the longitudinal direction of the intermediate hole and preventing backward flow at the second terminal end of the intermediate hole by displacing the central axis of the outlet hole from the longitudinal axis of the intermediate hole, the fluid can be more effectively atomized than in the above-described known injector nozzle.

Preferably, an edge defining an acute angle is formed in the fluid nozzle at a portion of a periphery of the outlet hole that is adjacent to the intermediate hole and is displaced or separated from the second terminal end of the intermediate hole. Therefore, the fluid that has flowed through the intermediate hole enters into the outlet hole and the direction of the flow will abruptly change by an angle of more than 90°. As a result, the flow of fluid may be effectively bubbled or burbled so as to improve the atomizing effect.

Optionally, the nozzle may include three plate members that are overlaid, or disposed substantially in parallel, with each other. For example, a first plate member may include the inlet hole, a second plate member may include the intermediate hole and a third plate member may include the outlet hole. This design can be utilized to easily and relatively cheaply manufacture a nozzle hole having three holes that are not aligned with each other. However, the three non-aligned holes also may be defined within a single plate or plate member, or within two plate members or plates.

In the present specification, the terms "nozzle hole," "inlet hole," "intermediate hole," and "outlet hole" may be replaced (or used interchangeably) with "nozzle passage," "inlet passage," "intermediate passage" and "outlet passage." Moreover, the terms "aperture," "bore," "cavity" and "orifice" also may be used interchangeably with "hole" or "passage." Furthermore, the terms "inlet hole" and "outlet hole" also may be respectively referred to as an "inlet port" and an "outlet port." In each case, the intended meaning is the same.

Thus, in another aspect of the present teachings, a fluid nozzle may include at least one nozzle passage that may comprise an inlet passage (port), an intermediate passage and an outlet passage (port). Preferably, the inlet passage is substantially aligned (e.g., substantially parallel) with the direction of fluid flow entering the inlet passage. For example, a fluid injector may supply pressurized fluid to the fluid nozzle and the fluid injector may have a substantially longitudinal axis along which the fluid flows within the fluid injector. Thus, the inlet passage is preferably substantially aligned (or substantially parallel) with the longitudinal axis of the fluid injector. The intermediate passage preferably communicates with the inlet passage and is disposed substantially perpendicular to the inlet passage. The outlet passage preferably communicates with the intermediate passage. Further, a longitudinal (or center) axis of the outlet passage preferably forms an acute angle with a longitudinal (or center) axis of the intermediate passage. Thus, the direction of the fluid flowing through the intermediate passage preferably changes by an angle of more than 90° in order to pass from the intermediate passage into the outlet passage. Optionally, the outlet passage may communicate with (or be disposed proximally to) a terminal end of the intermediate passage. In another optional embodiment, the longitudinal (or center) axis of the outlet passage may be displaced from the longitudinal (or center) axis of the intermediate passage, such that these two axes do not intersect.

According to another aspect of the present teachings, fuel injectors are taught that include a fluid nozzle having one or more of the above or below described features.

Additional objects, features and advantages of the present invention will be readily understood after reading the following detailed description together with the accompanying drawings and the claims.

DETAILED DESCRIPTION OF THE INVENTION

Figure 1:
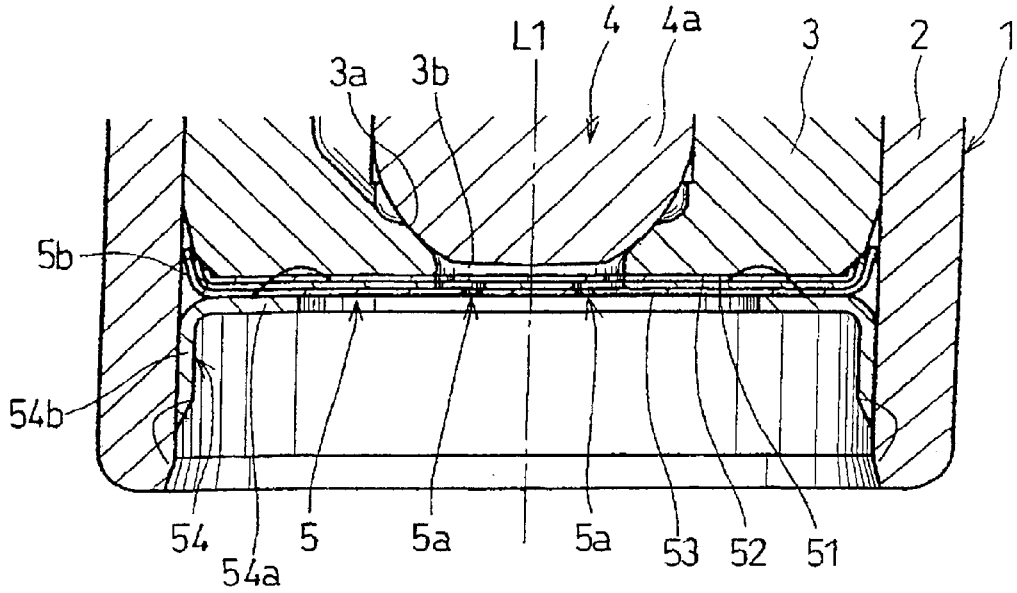
FIG. 1 is a front cross-sectional view of a portion of a representative fuel injection valve and a representative fuel injection nozzle.

In one representative embodiment, a fluid injection nozzle may have a central nozzle axis that is substantially aligned with a direction of fluid supplied to the fluid injection nozzle, e.g., by a fuel injector. The fluid injection nozzle may have at least one nozzle hole or passage that includes an inlet hole (or passage or port) and an outlet hole (or passage or port). An intermediate hole (or passage) preferably connects (or provides a communication path for) the inlet hole and the outlet hole. The inlet hole, the outlet hole and the intermediate hole may respectively have a first axis, a second axis and a third axis. The second axis and the third axis optionally may be displaced from each other in a direction substantially perpendicular to the central nozzle axis. That is, the second axis and the third axis preferably do not intersect. The intermediate hole may have a first terminal end and a second terminal end that are disposed opposite to each other along the direction of the third axis and communicate with the inlet hole and the outlet hole, respectively. The second axis and the third axis preferably define an acute angle when viewing a plane that is parallel, or substantially parallel, with the central nozzle axis.

In another representative embodiment, the intermediate hole preferably has a substantially elongated shape along the direction of the third axis and preferably has a substantially uniform width along the same direction. Optionally, the intermediate hole may have a substantially square or rectangular cross-section, although other cross-sections are contemplated. In addition, the first and second terminal ends of the intermediate hole may be rounded or arched shaped. Further, the inlet hole and the outlet hole may have substantially circular cross-sections, although again other cross-sections are contemplated.

In another representative embodiment, the second axis is inclined from the central nozzle axis (or the first axis) by an angle (i.e., first angle θ1) of less than 90°.

In another representative embodiment, the first axis may extend substantially within the same plane as the second axis. In addition, the second axis and the third axis may intersect, or come closest to each other (if these two axes do not intersect), proximally to the second terminal end of the intermediate hole. Furthermore, the second axis may be inclined relative to the third axis toward the first terminal end of the intermediate hole. Moreover, the second axis preferably extends toward the first axis, which first axis extends proximal to the first terminal end of the intermediate hole.

In another embodiment, the intermediate hole preferably has a substantially square or rectangular cross-section having a width W in a plate that is parallel, or substantially parallel, with the nozzle axis. Further, the outlet hole preferably has a substantially circular cross-section having a diameter ϕd. Preferably, ϕd is less than or equal to W. In one optional embodiment, the ratio W/ϕd may be less than about 2.

In another embodiment, the center of the second axis is displaced from the center of the third axis by a displacement (or offset) distance Y and Y is preferably less than or equal to the absolute value of (W−ϕd)/2. Optionally, in some embodiments, ϕd may be larger than W, although generally speaking ϕd is preferably less than W. If Y is relatively large, the ratio W/ϕd may be greater than 2 without diminishing the atomizing effect of the nozzle hole.

Each of the additional features and teachings disclosed above and below may be utilized separately or in conjunction with other features and teachings to provide improved fluid injection nozzles and fluid injectors and methods for designing and using such fluid injection nozzles and fluid injectors. A representative example of the present invention, which example utilizes many of these additional features and teachings both separately and in conjunction, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

A representative fuel injector nozzle 5 will now be described with reference to FIGS. 1 to 6. For example, a fuel injector may generally include a fuel injection valve 1 and the fuel injection nozzle 5, which are partially shown in the front cross-sectional view of FIG. 1. The fuel injection valve 1 may, e.g., include a body 2, a valve seat 3 and a movable valve member 4.

The body 2 may have a substantially cylindrical configuration. The valve seat 3 may be disposed within the front or downstream end (lower end as viewed in FIG. 1) of the body 2. The valve seat 3 may have an inner wall that defines a fuel flow channel. An annular valve seat surface 3*a* may be formed on the inner wall of the valve seat 3, and a circular injection hole 3*b* may be formed on the downstream side (lower side as viewed in FIG. 1) of the valve seat surface 3*a*.

Preferably, the valve member 4 may include a needle valve member and may be slidably disposed within the fuel flow channel of the valve seat 3. The valve member 4 may have a contact surface 4*a* that is designed to contact and seal the valve seat surface 3*a*. The contact surface 4*a* may have a substantially spherical shape, although the shape of contact surface 4*a* is not particularly limited. Preferably, the body 2 may be formed of a magnetic stainless steel, and the valve seat 3 and the valve member 4 may be formed of a non-magnetic stainless steel.

Pressurized fuel may be supplied to the fuel flow channel, e.g., by a fuel pump (not shown). The valve member 4 may reciprocate along an axial direction (e.g., the vertical direction as viewed in FIG. 1) of the body 2 so as to open the injection hole 3*b* and permit the pressurized fuel to be exhausted through the injection hole 3*b*. When the valve member 4 is disposed in a closed position, the pressurized fuel is prevented from passing through the injection hole 3*b*. Thus, as the contact surface 4*a* moves away from the valve seat surface 3*a* (i.e., the valve member 4 moves in the valve opening operation), the fuel is permitted to pass through the injection hole 3*b*. On the other hand, when the contact surface 4*a* contacts and seals the valve seat surface 3*a* (i.e., the valve closed position), fuel injection is prevented. Because a variety of known constructions can be utilized to manufacture the fuel injection valve 1, further description of the fuel injection valve 1 is not necessary. That is, the design of the fuel injection valve 1 is not particularly limited according to the present teachings and a variety of designs may be effectively utilized with the fluid nozzles of the present teachings.

The fuel injection nozzle 5 may be disposed on the downstream side (lower side as viewed in FIG. 1) of the valve seat 3 and may serve to atomize the pressurized fuel that passes through the injection hole 3*b*.

Figure 2:
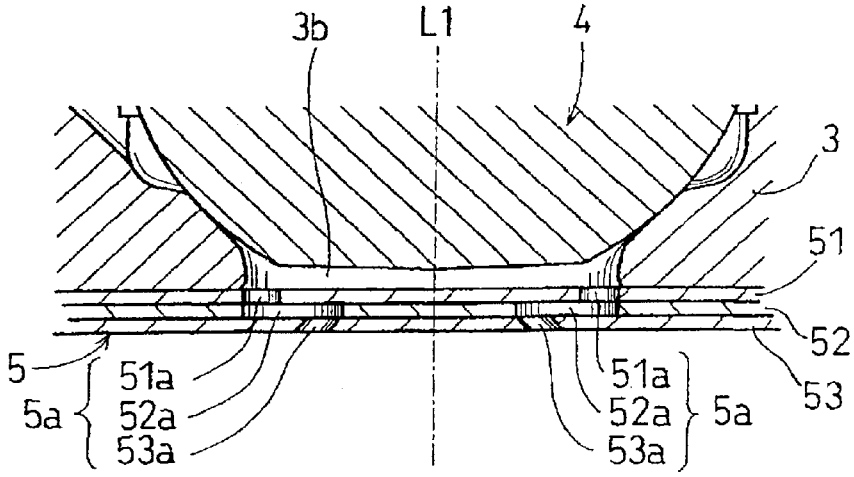
FIG. 2 is a partially enlarged view of FIG. 1.

As shown in FIG. 2, which is an enlarged view of a part of FIG. 1, the fuel injection nozzle 5 may include, e.g., first, second and third disk-shaped plate members 51, 52 and 53, which may be, e.g., made of stainless steel and are preferable disposed substantially in parallel. The first plate member 51 may be disposed on the upstream side, the third plate member 53 may be disposed on the downstream side and the second plate member 52 may be disposed or interleaved between the first and third plate members 51 and 53.

Referring to FIG. 1, a fitting portion 5*b* may be formed at the periphery of the fuel injection nozzle 5. The fitting portion 5*b* may be bent upward so as closely fit with the lower end of the valve seat 3 as viewed in FIG. 1. In this case, the first plate member 51 will securely contact the lower end surface of the valve seat 3.

Still referring to FIG. 1, a substantially ring-shaped plate holder 54 may be disposed below the third plate member 53. Preferably, the peripheral portion of the plate holder 54 may be bent to have a substantially inverted L-shaped configuration in cross section. A horizontal portion 54*a* of the plate holder 54 may be secured to the valve seat 3 together with the plate members 51, 52 and 53, preferably by means of laser welding. Therefore, the plate members 51, 52 and 53 will be positioned between the plate holder 54 and the valve seat 3. As shown in FIG. 1, a vertical portion 54*b* of the plate holder 54 may be bent downward from the periphery of the horizontal portion 54*a* and may be secured to the body 2, preferably by means of laser welding.

The fuel injection nozzle 5 may have a plurality of nozzle holes 5*a* (see FIG. 1). The nozzle holes 5*a* are preferably designed to control the flow of the fuel that passes through the injection hole 3*b* of the fuel injection valve 1, so that a step-wise change may be imparted to the flowing direction of the fuel. This step-wise change preferably serves to atomize the fuel that passes through the nozzle hole 5*a*.

The nozzle holes 5*a* will now be described in further detail. As shown in FIG. 2, each of the nozzle holes 5*a* may include an inlet hole (port) 51*a*, an intermediate hole (passage) 52*a* and an outlet hole (port) 53*a* that are respectively formed in the first plate member 51, the second plate member 52 and the third plate member 53. The intermediate hole 52 may be configured as a substantially elongated hole and may have opposing terminal ends that respectively communicate with the inlet hole 51*a* and the outlet hole 53*a*.

Figure 3:
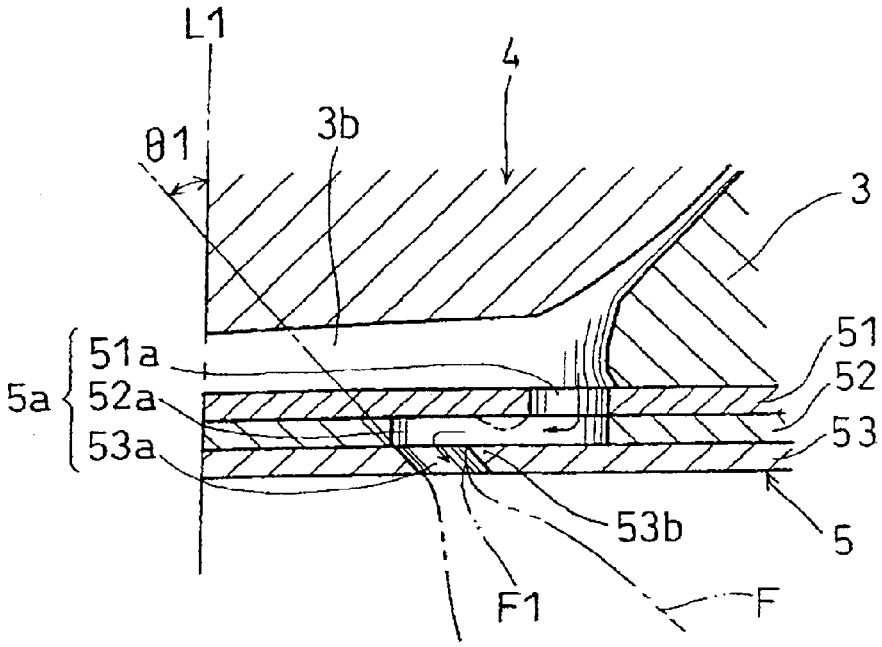
FIG. 3 is a partially enlarged view of FIG. 2.
Figure 4:
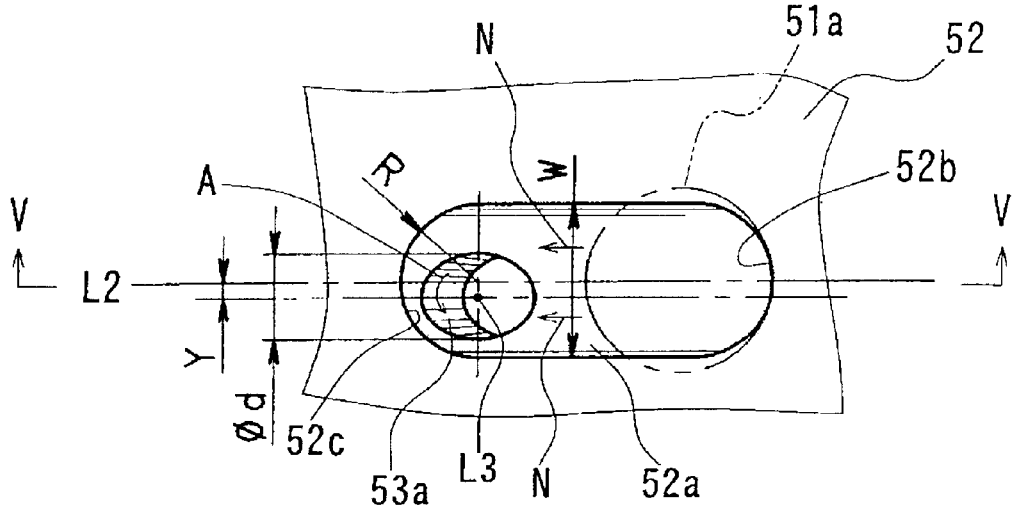
FIG. 4 is a schematic plan view of a portion of the fuel injection nozzle of FIG. 1.
Figure 5:
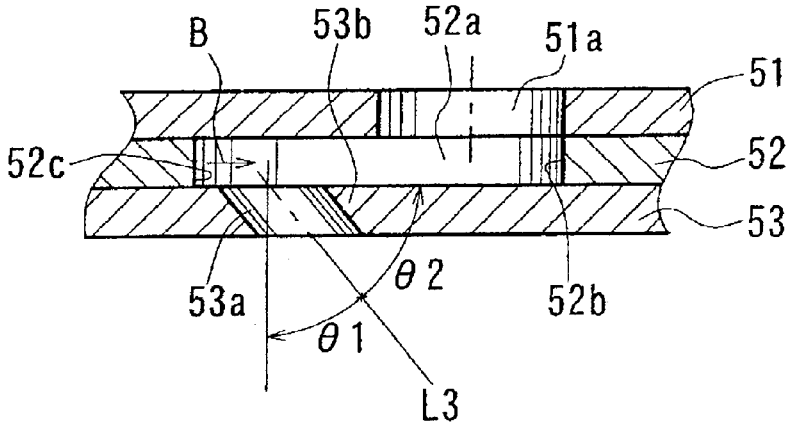
FIG. 5 is a sectional view taken along line V—V in FIG. 4.

As shown in FIGS. 3 to 5, the inlet hole 51*a* of the first plate member 51 may have a substantially circular cross section and may extend through the first plate member 51 in the vertical direction as viewed in FIGS. 3 and 5. In a preferred embodiment, the inlet hole 51*a* may have a central axis that extends substantially in parallel to a central axis L1 of the fuel injection nozzle 5. The plurality of inlet holes 51*a* may be appropriately distributed within an area defined by the injection hole 3*b* (see FIG. 2).

The number of the intermediate holes 52*a* of the second plate member 52 may be equal to the number of the inlet holes 51*a*. Preferably, each of the intermediate holes 52*a* may be elongated in a direction that is substantially perpendicular to the central axis L1 (see FIG. 3) of the fuel injection nozzle 5, which may be the radial direction (right and left directions as viewed in FIG. 3) of the fuel injection nozzle 5. In addition, each of the intermediate holes 52*a* may extend through the second plate member 52 in the vertical direction as viewed in FIGS. 3 and 5.

As shown in FIG. 4, the intermediate hole 52*a* may have a first terminal end surface 52*b* that is defined on the side of the inlet hole 51*a* (upstream side) and a second terminal end surface 52*c* that is defined on the side of the outlet hole 53*a* (downstream side). The first and second terminal end surfaces 52*b* and 52*c* may each have an arch-shaped or rounded configuration with a radius R of curvature. In addition, the intermediate hole 52*a* may have a uniform width W along the longitudinal direction of the intermediate hole 52*a*. A first terminal end or the upstream-side end (right side end as viewed in FIG. 5) of the intermediate hole 52*a* may communicate with the corresponding inlet hole 51*a* of the first plate member 51. As shown in FIG. 4, the inlet hole 51*a* may have a radius that is slightly greater than the radius R of the first terminal end surface 52*b*.

The number of outlet holes 53*a* of the third plate member 53 also may be the same as the number of inlet holes 51*a*, as well as the number of intermediate holes 52*a*. As shown in FIGS. 3 to 5, each of the outlet holes 53*a* may have a substantially circular cross section and may extend through the third plate member 53 in the vertical direction as viewed in FIGS. 3 and 5. However, each of the outlet holes 53*a* are preferably inclined by an angle of θ1 relative to the central axis L1 of the fuel injection nozzle 5 in a direction away from the central axis L1 and toward the downstream side or the flowing direction of the fluid (downward direction as viewed in FIG. 3). Preferably, angle θ1 is an acute angle and, e.g., may be an angle of about 40°. Thus, the outlet hole 53*a* is preferably inclined by an acute angle relative to the intermediate hole 52*a*, thereby forming a fluid turning channel therebetween. A second terminal end or the downstream-side end (left side end as viewed in FIG. 5) of the intermediate hole 52*a* may communicate with the corresponding outlet hole 53*a* of the third plate member 53.

In addition, as shown in FIG. 3, the third plate member 53 may define an edge 53*b* at the periphery of the outlet hole 53*a* in a position that is opposite to the second terminal end or the downstream side end of the intermediate hole 52*a*. Thus, the edge 53*b* may be positioned within the turning point of the flow of the fuel, which turning point is indicated by a bent arrow in FIG. 3. The edge 53*b* preferably defines angle θ2 as shown in FIG. 5, in which θ2=90°−θ1. Thus, if angle θ1 is about 40°, angle θ2 will be about 50°, and thus, angle θ2 also will define an acute angle.

In preferred embodiments, the diameter φd of the outlet hole 53*a* may be less than the width W of the intermediate hole 52*a*.

Further, a central axis L3 of the outlet hole 53*a* may preferably be displaced from a central longitudinal axis L2 of the intermediate hole 52*a* by a distance Y. In this embodiment, the central axis L3 and the central longitudinal axis L2 will not intersect. In another preferred embodiment, Y may be greater than zero and less than or equal to the absolute value of (W−φd)/2.

Preferably, the inlet holes 51*a* of the first plate member 51, the intermediate holes 52*a* of the second plate member 52 and the outlet holes 53*a* of the third plate member 53 may be formed by perforating the respective plate member using a press machine. The thickness of the third plate member 53 may be selected so as to provide a suitable length for each outlet hole 53*a*, which length is sufficient to impart direction to the fuel that passes through the outlet hole 53*a*. Preferably, the plate members 51, 52 and 53 may have the same thickness, although the plate members 51, 52 and 53 may each have a different thickness.

The above described fuel injector valve 1, which includes the fuel injection nozzle 5, may be mounted on an engine, such as an internal combustion engine of a vehicle, so that the nozzle axis L1 (shown in FIG. 1) substantially extends in the vertical direction with respect to the fuel injection nozzle 5 positioned at the lower end of the injector. If this arrangement is utilized, vaporized fuel contained in the fluid that is disposed within the nozzle holes 5*a* may easily rise upward within the nozzle holes 5*a* in order to be removed. Therefore, the performance of the injector can be improved in particular, when the injector is heated to a high temperature.

In operation, when the fuel injection valve 1 (see FIG. 1) is opened, the fuel passing through the injection hole 3*b* may flow through the inlet hole 51*a*, the intermediate hole 52*a* and the outlet hole 53*a* (see FIGS. 2 and 3) of each of the nozzle holes 5*a*, so that the stepwise control of the flowing direction of the fuel may be imparted as indicated by arrows in FIG. 3. The fuel may then be exhausted through the nozzle holes 5*a* as indicated by chain line F, which is also shown in FIG. 3.

Because the fuel flows through the elongated intermediate hole 52*a*, which hole 52*a* extends substantially perpendicular to the central axis L1 of the nozzle 5 and has a uniform width W along its length, the fuel will flow in the horizontal direction as indicated by arrow N in FIG. 4.

In addition, if the central axis L3 of the outlet hole 53*a* is displaced from the longitudinal central axis L2 of the intermediate hole 52*a* by the distance Y (see FIG. 4), the fuel that flows in the horizontal direction within the intermediate hole 52*a* may be prevented from returning in the exact opposite direction (the direction as indicated by arrow B in FIG. 5). Therefore, when the fuel flow collides with the second terminal end surface (left side end surface) 52*c* of the intermediate hole 52*a*, the fuel flow can be prevented from returning backward (i.e., backflow is prevented). More specifically, if the central axis L3 of the outlet hole 53*a* is displaced from the longitudinal central axis L2 of the intermediate hole 52*a*, the central stream line of the fuel flowing through the intermediate hole 52*a* may collide with the second terminal end surface 52*c* at a point that is displaced from the central axis L3. As a result, the fuel may circulate along the second terminal end surface 52*c* as indicated by arrow A in FIG. 4, so that the fuel may be prevented from returning backward (as indicted by the arrow B in FIG. 5).

By generating a flow of fluid in the horizontal direction (i.e., substantially perpendicular to the central nozzle axis L1) within the intermediate hole 52*a* and by preventing backward flow at the second terminal end surface 52*c* of the intermediate hole 52*a*, a multiplied or amplified atomizing effect may be generated, which will increase the atomization of the fuel that flows out of the outlet hole 53.

In addition, if the edge 53*b* is positioned substantially at the turning point of the fuel flow entering from the intermediate hole 52*a* into the outlet hole 53*a*, which feature was described above with reference to FIG. 3, the direction of horizontally flowing fuel within the intermediate hole 52*a* will abruptly turn by an angle that is greater than 90° and then may enter the outlet hole 53*a*. Therefore, increased bubbling or burbling within the fuel flow can be generated, as indicated by chain line F1 in FIG. 3. As a result, atomizing efficiency also may be improved in this embodiment.

By improving fuel atomization using the nozzle holes 5*a*, the fuel can be effectively mixed with air over a broad mixing ratio. Therefore, fuel combustion efficiency can be improved. As a result, incompletely combusted gases exhausted from the engine may be reduced and thus, fuel consumption can be reduced.

Figure 6:
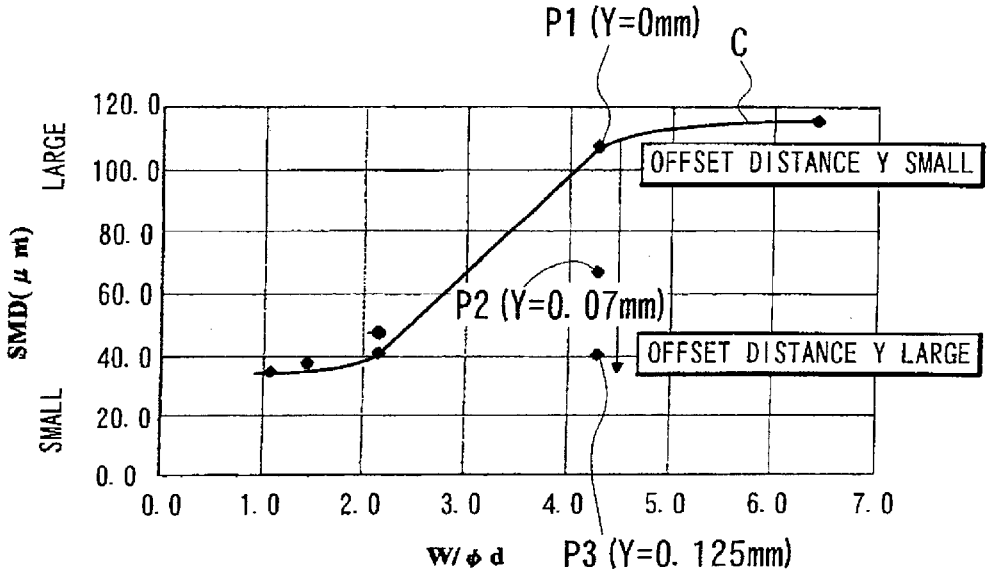
FIG. 6 is a graph showing the relationship between the ratio (W/ϕd) of the width W of an elongated hole to the diameter ϕd of an outlet hole and the size of atomized fuel particles (in microns) that are generated.
Figure 7:
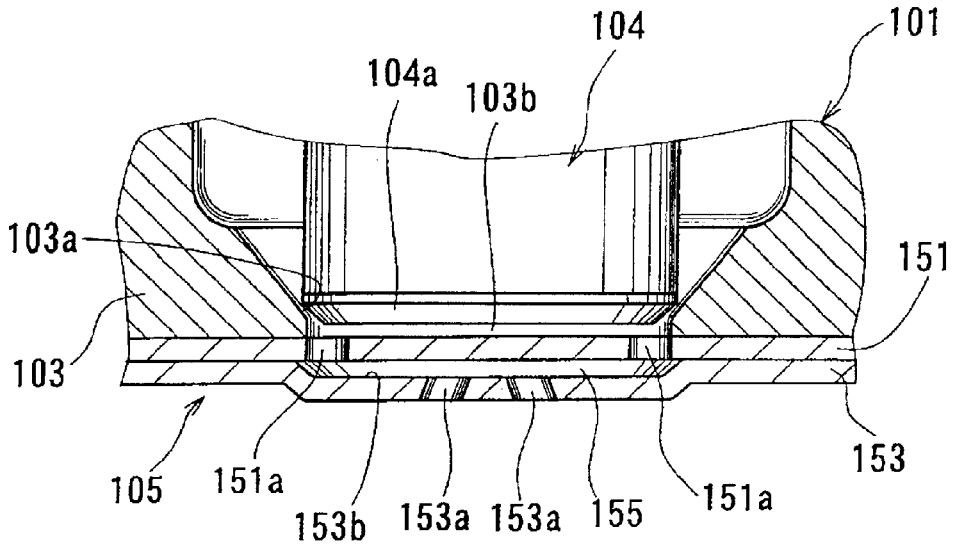
FIG. 7 PRIOR ART
FIG. 7 is a sectional view of a portion of a known fluid injection valve having an injection nozzle.
Figure 8:
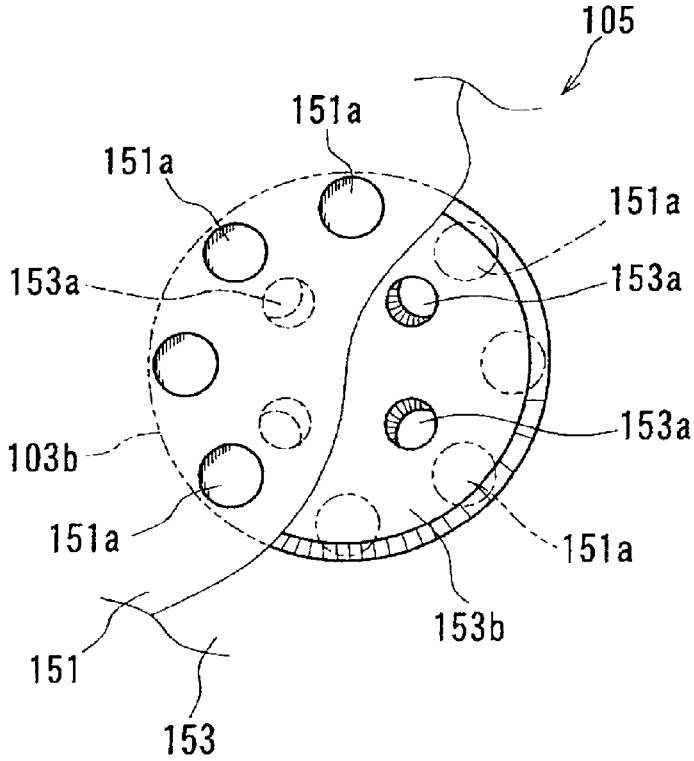
FIG. 8 PRIOR ART
FIG. 8 is a broken-away plan view of a portion of the fluid injection nozzle shown in FIG. 7.

FIG. 6 shows a graph illustrating the relationship between the ratio (W/ϕd) of the width W of the intermediate hole 52*a* (see FIG. 4) to the diameter ϕd of the outlet hole 53*a* (see FIG. 4) and the mean diameter of (atomized) fuel particles (SMD) that are exhausted from the fuel injector nozzle 5. In FIG. 6, the abscissa represents the ratio (W/ϕd) and the ordinate represents the mean diameter of the exhausted (atomized) fuel particles (SMD (μm)). In this specification, "SMD" is an abbreviation of "Sauter's Mean Diameter." Further, in the results shown in FIG. 6, the diameter ϕd was set to 0.14 mm.

In this example, the characteristic line C shown in FIG. 6 represents the change in the mean diameter of the exhausted fuel particles (SMD) when Y is zero. As further shown in FIG. 6, Points P1, P2 and P3 represent the results when the displacement distance Y (i.e., the distance between the central axis L3 of the outlet hole 53*a* and the longitudinal central axis L2 of the intermediate hole 52*a*) is gradually increased from zero when the ratio (W/ϕd) was held fixed.

As will be understood from Points P1, P2 and P3 shown in FIG. 6, the mean diameter of the exhausted fuel particles (SMD) decreases as the displacement distance Y increases. Thus, atomizing efficiency may be improved by increasing Y. Further, the characteristic line C shown in FIG. 6 indicates that the mean diameter of the exhausted fuel particles (SMD) also decreases as the ratio (W/ϕd) approaches to 1 (i.e., W=ϕd), also thereby improving atomizing efficiency.

In addition, in this representative embodiment, three plate members 51, 52 and 53 having the inlet holes 51*a*, the intermediate holes 52*a* and the outlet holes 53*a*, respectively, are disposed substantially in parallel with each other in order to form the nozzle 5. Therefore, a plurality of nozzle holes 5*a* can be easily fabricated in the nozzle S.

Further, injectors having improved atomizing efficiency may be provided by utilizing the fuel injection nozzle 5 of this representative embodiment (see FIG. 1).

The present teachings are not limited to the representative embodiments described above, but may be modified in various ways without departing from the spring of the present invention. For example, the present teachings also may be applied to injection nozzles or injectors for fluids other than fuel. In this regard, the present teachings will find advantageous application in any field in which a fluid or liquid is desired to be atomized.

In addition, any two of the inlet holes 51*a*, the intermediate holes 52*a* and the outlet holes 53*a* that directly communicate with each other may be formed within a single plate member. For example, the inlet holes 51*a* and the intermediate holes 52*a* (or the intermediate holes 52*a* and the outlet holes 53*a*) may be formed within a single plate member. Moreover, it is not necessary to utilize perforated plate members to form the nozzle 5 having the nozzle holes 5*a*. Furthermore, although each of the nozzle holes 5*a* has three holes 51*a*, 52*a* and 53*a*, each nozzle hole 5*a* may comprise four or more holes (passages). Thus, the number and the configuration of the holes (passage) that constitute the nozzle hole 5*a* are not limited to those described in the above representative embodiment, but instead may be suitably changed depending upon the particular application of the present teachings.

What is claimed is:

1. A fluid injection nozzle arranged and constructed to be mounted on a fluid injector valve in order to control a flow of fluid passing through an injection hole of the fluid injector valve, the fluid injection nozzle comprising:

at least two nozzle holes, each having an inlet hole, an intermediate hole and an outlet hole, each nozzle hole imparting a step-wise control of the flow of fluid supplied from the injection hole, wherein each intermediate hole has a longitudinal axis that extends substantially perpendicularly toward a central nozzle axis, each intermediate hole includes a first terminal end that communicates with the respective inlet hole and a second terminal end that communicates the respective outlet hole, each intermediate hole has a substantially uniform width along substantially the entire length of the intermediate hole in the direction of the longitudinal axis (L2) and each outlet hole has a central axis (L3) that is displaced from the longitudinal axis (L2) of the respective intermediate hole.

2. A fluid injection nozzle as in claim 1, further comprising an edge defining an acute angle and formed at a portion of a periphery of the outlet hole that is adjacent to the intermediate hole and is spaced from the second terminal end of the intermediate hole.

3. A fluid injection nozzle as in claim 1, further comprising three plate members disposed substantially in parallel with each other, wherein the inlet hole, the intermediate hole and the outlet hole each are formed in the respective plate members.

4. A fluid injection nozzle having a central nozzle axis (L1) comprising:

at least two nozzle holes, each comprising an inlet hole, an outlet hole and an intermediate hole connecting the inlet hole and the outlet hole, wherein each inlet hole has a first longitudinal axis, each intermediate hole has a second longitudinal axis and each outlet hole has a third longitudinal axis (L3), wherein the first longitudinal axis of the inlet hole is substantially perpendicular to the second longitudinal axis (L2) of the intermediate hole, each intermediate hole has a first terminal end and a second terminal end that are disposed opposite to each other along the direction of the second longitudinal axis (L2), wherein the first terminal end communicates with the inlet hole and the second terminal end communicates with the outlet hole, and wherein, at the second terminal end of each intermediate hole, the second longitudinal axis (L2) is displaced from the third longitudinal axis (L3) by a displacement distance (Y) within a plane that is substantially perpendicular to the central nozzle axis (L1).

5. A fluid injection nozzle as in claim 4, wherein each intermediate hole is formed as an elongated hole along the direction of the second longitudinal axis (L2) and has a substantially uniform width (W) along the same direction.

6. A fluid injection nozzle as in claim 5, wherein the third axis (L3) is inclined by a first angle θ1 relative to the central nozzle axis (L1), wherein the first angle θ1 is an acute angle.

7. A fluid injection nozzle as in claim 6, wherein the third longitudinal axis (L3) of each outlet hole is inclined relative to the corresponding second longitudinal axis (L2) as the third longitudinal axis extends away from the second terminal end of the respective outlet hole.

8. A fluid injection nozzle as in claim 7, wherein each outlet hole has a diameter (ϕd) that is less than or equal to a width (W) of the respective intermediate hole.

9. A fluid injection nozzle as in claim 8, wherein the displacement distance (Y) for each nozzle hole is greater than zero and less than or equal to (W−ϕd)/2.

10. A fluid injection nozzle as in claim 4, wherein each outlet hole has a diameter (ϕd) that is less than or equal to a width (W) of the respective intermediate hole.

11. A fluid injection nozzle as in claim 4, wherein the displacement distance (Y) for each nozzle hole is greater than zero and less than or equal to the absolute value of (W−ϕd)/2, wherein ϕd is the diameter of the outlet hole (53*a*) and W is the width of the intermediate hole (52*a*).

12. A fluid injector valve comprising a valve seat having the injection hole, wherein the fluid injection nozzle of claim 11 is coupled to the valve seat.

13. A fluid injector valve comprising a valve seat having the injection hole, wherein the fluid injection nozzle of claim 4 is coupled to the valve seat.

14. A nozzle comprising:

a plate member having a plurality of fluid passages extending through the plate member, each fluid passage comprising an inlet passage, an intermediate passage and an outlet passage, wherein for each fluid passage:

(a) a first central longitudinal axis is defined within the inlet passage, a second central longitudinal axis is defined within the intermediate passage and a third central longitudinal axis is defined within the outlet passage, (b) the intermediate passage has an elongated shape with a first terminal end and a second terminal end that opposes the first terminal end, (c) the inlet passage communicates with the intermediate passage proximally to the first terminal end and the outlet passage communicates with the intermediate passage proximally to the second terminal end, (d) the first central longitudinal axis is substantially perpendicular to the second central longitudinal axis, (e) the second central longitudinal axis does not intersect the third central longitudinal axis, but the second central longitudinal axis and the third central longitudinal axis form an acute angle when viewed perpendicularly from a plane defined by the first longitudinal axis and the second longitudinal axis, and (f) the outlet passage is substantially circular and has a diameter (ϕd), the intermediate passage has a substantially uniform width (W) along the second central longitudinal axis and ϕd is less than or equal to W.

15. A nozzle as in claim 14, wherein the plate member comprises a first plate having the inlet passage, a second plate having the intermediate passage and a third plate having the outlet passage, the first, second and third plates being disposed substantially in parallel.

16. A nozzle as in claim 14, wherein, proximal to the second terminal end of the intermediate passage, the second central longitudinal axis is displaced from the third central longitudinal axis by a distance that is greater than zero and less than or equal to (W−ϕd)/2.

17. A nozzle as in claim 14, wherein the intermediate passage and the outlet passage are arranged and constructed so that fluid flowing through the intermediate passage must turn by an angle of more than 90° in order to pass into the outlet passage.

18. A nozzle as in claim 14, wherein the inlet passage adjoins the first terminal end of the intermediate passage in a substantially perpendicular relationship and the inlet passage is substantially circular in cross-section.

19. An apparatus suitable for atomizing a fluid, comprising:

the nozzle of claim 14, and means for supplying the fluid under pressure to the nozzle.

20. An apparatus as in claim 19, wherein the means for supplying the fluid under pressure to the nozzle comprises a vehicle fuel injector.

21. A fluid injection nozzle having a central nozzle axis (L1) comprising:

at least two nozzle holes, each comprising an inlet hole, an outlet hole and an intermediate hole connecting the inlet hole and the outlet hole, wherein each inlet hole has a first longitudinal axis, each intermediate hole has a second longitudinal axis (L2) and each outlet hole has a third longitudinal axis (L3), wherein the first longitudinal axis of the inlet hole is substantially perpendicular to the second longitudinal axis (L2) of the intermediate hole, each intermediate hole has a first terminal end and a second terminal end that are disposed opposite to each other along the direction of the second longitudinal axis (L2), wherein the first terminal end communicates with the inlet hole and the second terminal end communicates with the outlet hole, and wherein, each intermediate hole is formed as an elongated hole along the direction of the second longitudinal axis (L2) and has a substantially uniform width (W) along the same direction, and each intermediate hole and the corresponding outlet hole are arranged and constructed so that fluid flowing through the intermediate hole must turn by and angle of more than 90° in order to pass into the outlet hole and to thereby producing burbling of the flow within the outlet hole.

22. A fluid injection nozzle as in claim 21, wherein the third longitudinal axis (L3) is inclined by a first angle θ1 relative to the central nozzle axis (L1), wherein the first angle θ1 is an acute angle.

23. A fluid injection nozzle as in claim 22, wherein the first angle θ1 is about 40°.

24. A fluid injection nozzle as in claim 22, wherein the third longitudinal axis (L3) is substantially parallel to a plane defined by the first longitudinal axis and the second longitudinal axis (L2).

25. A fluid injection nozzle as in claim 24, wherein the third longitudinal axis (L3) is displaced by a displacement distance (Y) from the plane that is defined by the first longitudinal axis and the second longitudinal axis (L2).

* * * * *